United States Patent [19]

Kai

[11] Patent Number: 4,465,215

[45] Date of Patent: Aug. 14, 1984

[54] CUTTING EDGE FOR DISPENSING CONTAINER

[75] Inventor: Hisao Kai, Chiba, Japan

[73] Assignee: Asahi-Dow Limited, Tokyo, Japan

[21] Appl. No.: 339,010

[22] Filed: Jan. 12, 1982

[30] Foreign Application Priority Data

| | | | |
|---|---|---|---|
| Jan. 27, 1981 | [JP] | Japan | 56/9649 |
| Mar. 10, 1981 | [JP] | Japan | 56/33193 |
| Apr. 28, 1981 | [JP] | Japan | 56/63339 |

[51] Int. Cl.[3] ..... B65D 85/671

[52] U.S. Cl. ..... 225/48; 225/91

[58] Field of Search ..... 225/48–50, 225/91; 493/86, 128

[56] References Cited

U.S. PATENT DOCUMENTS

| | | | |
|---|---|---|---|
| 1,952,431 | 3/1934 | Gluck et al. | 225/91 X |
| 2,189,533 | 2/1940 | Harvey | 225/49 |
| 2,771,186 | 11/1956 | Burbank | 225/91 X |
| 2,888,180 | 5/1959 | Kinker, Jr. | 225/91 X |
| 2,888,181 | 5/1959 | Lincoln et al. | 225/48 X |
| 3,193,427 | 7/1965 | Rogers | 225/49 X |
| 3,281,036 | 10/1966 | Woodling | 225/49 |
| 4,005,809 | 2/1977 | Finn | 225/49 |
| 4,334,644 | 6/1982 | Hauser | 225/48 X |
| 4,340,162 | 7/1982 | Heiman et al. | 225/48 |
| 4,346,830 | 8/1982 | Hauser | 225/49 |

FOREIGN PATENT DOCUMENTS

| | | | |
|---|---|---|---|
| 2927195 | 1/1981 | Fed. Rep. of Germany | 225/48 |
| 48-36392 | 5/1973 | Japan . | |

*Primary Examiner*—Frank T. Yost

*Attorney, Agent, or Firm*—Armstrong, Nikaido, Marmelstein & Kubovcik

[57] ABSTRACT

A cutting device using as its cutting edge a coarse file-like face, a method for cutting a thin sheet or film by causing at least the cut-starting portion of the thin sheet or film to be pressed against the coarse file-like face of the cutting device, and a dispenser for a thin sheet or film provided with the aforementioned cutting device using said coarse file-like face as a cutting edge thereof are disclosed. A thin sheet or film is readily torn when a notch or cut is formed at the cut-starting portion of the sheet or film. The present invention makes use of this property of the thin sheet or film.

10 Claims, 27 Drawing Figures

CUTTING EDGE FOR DISPENSING CONTAINER

BACKGROUND OF THE INVENTION

This invention relates to a safe cutting device for cutting a thin sheet or film such as a thin sheet or film of synthetic resin, aluminum foil, waxed paper, parchment paper, or glassine, to a method for cutting such thin sheet or film by use of the cutting device, and to a thin sheet or film dispenser provided with the cutting device in such a manner that the thin sheet or film stored within the dispenser may be drawn to a desired length from the dispenser and ripped along the edge of the cutting device.

The conventional cutting devices of general run such as represented by knives, scissors, and saws have sharp, large exposed blades. When they are touched accidentally by human flesh even very lightly, they tend to inflict serious wounds thereon. The class of cutting devices used for cutting thin sheets and films, the articles to which the present invention is directed, are no exceptions.

To permit convenient use of thin sheets and films, there prevails a popular practice of storing the thin sheets and films as rolled or folded in dispensers, drawing them to desired lengths out of the dispensers whenever they are desired to be used, and ripping them along the edges of cutting devices disposed at the outlets of the dispensers.

The cutting devices provided for the thin sheet or film dispensers are represented by metal plates containing saw-toothed cutting blades readily found in dispensers for synthetic resin films, aluminum foils, and waxed papers, etc. now enjoying widespread household use. A typical saw-toothed cutting blade used in a dispenser is illustrated in FIG. 23.

Unfortunately, the thin sheet or film dispensers which are provided with such metal-plate cutting devices incorporating saw-toothed cutting blades possess various defects such as are enumerated below.

Firstly, their users readily sustain injuries on their hands and fingers through inadvertent exposure thereof to a direct touch on the edges of such cutting blades.

Secondly, the blade of the tool used for forming saw-toothed cutting blades in metal plates to produce the cutting devices under discussion is susceptible to quick wearing by use. When the blade of the tool is worn even to a slight extent, burrs occur on the saw-toothed cutting blades of the cutting devices to be produced. These burrs often scratch the hands and fingers of the users of the cutting devices. Preclusion of the occurrence of these burrs necessitates frequent replacement of the cutting blade of the tool or setting of the saw-toothed edge of the tool. Consequently, the thin sheet or film dispensers provided with the saw-toothed cutting devices suffer from poor efficiency of production. In the attachment of the metal-plate cutting devices containing saw-toothed cutting blades to the cases of dispensers, the cutting edges of the devices must be positioned accurately at a fixed distance from the corners of the dispensers. If the cutting edges protrude excessively from the corners, they pose a danger at all times. If they protrude insufficiently from the corners, they fail to form desired cuts in the thin sheets or films. The great accuracy with which the cutting edges are required to protrude from the corners of the dispensers also constitutes itself one of the factors for the poor efficiency of production of the dispensers.

Thirdly, since most dispensers for thin sheets or films of synthetic resin, aluminum foil, or waxed paper are in the shape of elongated rectangular parallelepipeds as illustrated in FIG. 23, the aforementioned cutting devices fastened along one longitudinal corner of the dispensers with the cutting edges 609 protruding therefrom to a length of 1 to 2 mm are generally prevented from the possibility of the cutting edges 609 inflicting injuries on persons handling the dispensers at all the stages of distribution channel between the producers and the end users and, at the same time, protected against the possibility of their cutting edges 609 sustaining damage due to collision with hard objects. For this purpose, the front flaps 604 of the containers of dispensers 601 are extended past the upper surfaces 602 enough to form covering pieces 607 capable of keeping the cutting edges 609 covered thereunder at all times. Since the outermost portions of these covering pieces 607 are slanted because of the protrusion of the cutting edges 609 from the corners of the containers, they tend to prevent the dispensers from being neatly piled up in perfectly level positions as shown in FIG. 24 during storage, transportation, or display. When the dispensers piled up in heaps are suffered to tumble down, the impacts may be so serious as to possibly bend the cutting edges 609 out of their usefulness despite the protection offered by the covering pieces 607 or to cause separation of the covering pieces 607, with the result that the dispensers will have their market value degraded. Further, the protrusion of the leading ends of the covering pieces 607 from the rear surfaces 605 of the containers also interferes with neat stacking of the dispensers and causes separation of the covering pieces 607 themselves.

Fourthly, while the thin sheets or films such as of vinylidene chloride are not easily torn in the absence of a cut, they are readily torn from a very slight cut inserted in their boundaries. This attribute is not peculiar to vinylidene chloride films but is common to thin sheets or films of a variety of materials. Particularly in the case of rolled thin sheets or films such as those of vinylidene chloride which possess low tear propagation strength and ample self-tackiness and rolled thin sheets or films vested with tackiness, when the freshly cut ends of such thin sheets or films happen to adhere fast to the outermost walls of the rolls and the cut ends are subsequently desired to be separated from the rolls and drawn out, since the cut ends are zigzagged in the shape of a sawtooth because of the saw-toothed edges of the cutting devices used on the dispensers, the sheets or films tend to be torn from some of the V-shaped notches of the saw-toothed cut ends in the direction in which the sheets or films are being drawn out. Thus, once the cut ends are suffered to adhere fast to the rolls, it is extremely difficult for the adhering cut ends to be drawn out of the rolls afterward.

Various attempts have been being made with a view of overcoming the various defects mentioned above which are suffered by metal-plate cutting devices incorporating saw-toothed cutting blades. All these attempts nevertheless adhere to the basic concept of imparting cuts to the thin sheets or films by means of saw-toothed cutting edges. They are invariably directed to improvements in material, in blade strength, or in blade position relative to the dispensers. Thus, all the improvements brought about by the efforts heretofore made have not served to overcome the defects due to the saw-toothed edges of the cutting blades.

For example, since most dispensers for thin sheets or films are made of cardboard paper, it has been attempted to form parts of such cardboard dispenser cases in the shape of sawtooth and utilize the saw-toothed edges as cutting blades. Paper by nature is deficient in toughness. Even cardboard paper is easily bent under the shear stress exerted thereon when the thin sheet or film is ripped against the saw-toothed edge. Owing to the abrupt decrease of width in the individual points of the sawtooth coupled with the inferior binding force between the individual fibers making up the paper, the strength used in forcibly ripping the thin sheet or film against the sawtooth crushes the points of the sawtooth. Thus, the saw-toothed edges formed in the cardboard dispenser cases fail to withstand repeated use as cutting devices.

A method for enhancing the toughness of the points of the saw-toothed edges formed in the cardboard dispenser cases by causing the saw-toothed edges to be impregnated with an adhesive agent or resin solution has been disclosed by Japanese Patent Publication No. 36392/1973. This publication happens to contain a statement to the effect that a resin layer containing metal or glass powder is formed on the surfaces of the saw-toothed cutting edge. The cutting of a thin sheet or film as disclosed in this publication depends solely on the saw-toothed edge. The technical idea of the present invention which resides in effecting desired cutting of a thin sheet or film with a coarse file-like surface, a novel cutting device, is neither disclosed nor suggested anywhere in this patent publication.

A field test of this method has revealed that the method provides effective cutting for limited types of films, fails to cut the films smoothly, and leaves rugged edges in the cut ends. This is because the method effects the cutting of a thin sheet or film by causing the applied stress to concentrate at the sharp points of the sawtooth formed in the cardboard dispenser case. The rigid material such as glass powder used along the saw-toothed edge is solely intended to reinforce the saw-toothed edge of the cardboard paper. The greater part of the powdered rigid material is absorbed into the cardboard paper to form a base of impregnation therein and only a part thereof is used in the formation of a surface layer. Since the cardboard paper is a soft material, the extent to which the sharpness of the points of the saw-toothed edge is enhanced by use of the powdered rigid material is limited. This method cannot be expected to satisfy both safety and sharpness of the cutting edge of cardboard paper through the reinforcement contemplated thereby.

Because of these drawbacks suffered by such methods of improvement the dispensers for thin sheets or films which are provided with metal-plate cutting devices containing saw-toothed cutting edges and therefore entailing the various defects mentioned previously are still in popular use.

SUMMARY OF THE INVENTION

This invention has issued from the discovery that a coarse file-like face formed of a substance having greater rigidity than the thin sheet or film to be cut lacks a sharp cutting edge and ensures safe handling, that the individual cutting ridges of the coarse file-like face have sharpness enough to inflict cuts to the thin sheet or film when the sheet or film is pressed down against the ridges, that a slight pull given at the thin sheet or film against the coarse file-like face causes the thin sheet or film to be ripped smoothly along the portion pressed against the coarse file-like face, and that once a notch for starting the cut is inserted as described above, the thin sheet or film can be easily torn with relatively slight force exerted by hand.

The first object of this invention is to provide a safe, easily manufacturable cutting device for a thin sheet or film, using as its cutting edge a coarse file-like face totally different from all the cutting devices of the conventional concept.

The second object of this invention is to provide a method for cutting a thin sheet or film by use of the aforementioned cutting device, i.e. by the steps of linearly pressing the portion of the thin sheet or film desired to be cut against the coarse file-like face which is the cutting edge of the cutting device described above, pulling the thin sheet or film against the coarse file-like face, and ripping the thin sheet or film by virtue of the cuts inflicted upon the sheet or film by the pressure exerted thereto against the coarse file-like face.

The third object of this invention is to provide a thin sheet or film dispenser which is provided at a position easy to start cutting the thin sheet or film drawn out of the dispenser with the cutting device using as its cutting edge the aforementioned coarse file-like face instead of the conventional metal-plate cutting device incorporating the saw-toothed cutting edge, whereby all the defects caused by the metal-plate cutting device are completely eliminated.

The other characteristics and advantages of the present invention will become apparent from the further disclosure of the invention to be made herein below with reference to the accompanying drawings.

DETAILED DESCRIPTION OF THE INVENTION

Figure 1:
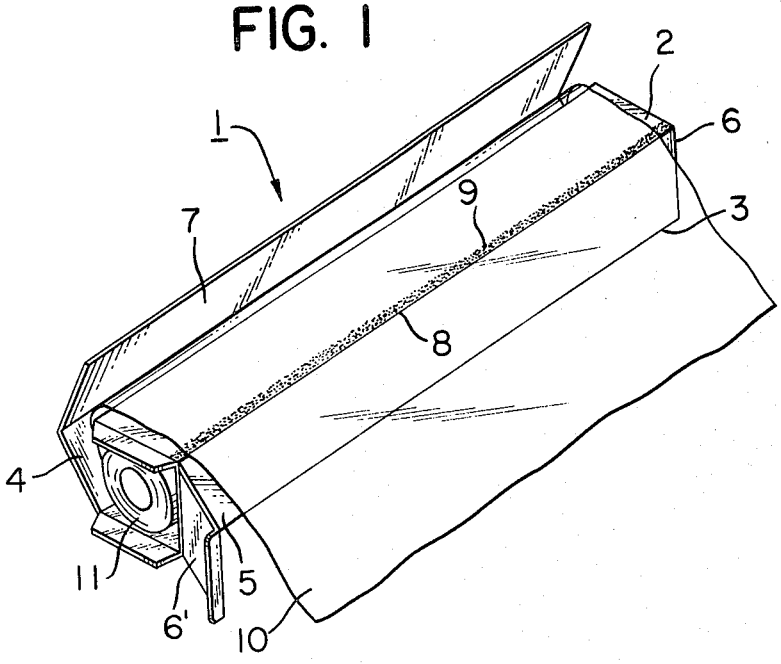
FIG. 1 is a perspective view of a typical thin sheet or film dispenser using the cutting device of the present invention.

FIG. 1 is a perspective view illustrating one typical thin sheet or film dispenser provided with the cutting device of the present invention.

In the diagram, 1 denotes the main body of the dispenser, which comprises an upper wall 2 (hereinafter referred to as "first wall"), a lower wall 3 (hereinafter referred to as "third wall"), a front wall 4 (hereinafter referred to as "fourth wall"), a rear wall 5 (hereinafter referred to as "second wall"), two lateral walls 6, 6', and a covering piece 7. The dispenser as a whole is a box of the shape of an elongated rectangular parallelepiped. The fourth wall 4 is freely foldable with reference to the third wall 3. It can be opened or closed with reference to the first wall 2 because its edge falling near the first wall 2 is not bound to the first wall 2. From the free end of the fourth wall 4 is extended the covering piece 7 serving to cover the first wall 2. Along the edge of the first wall 2 of the main body 1 bordering on the second wall 5, a coarse file-like face 9 is formed adjacent to the corner 8 of the first wall 2 and the second wall 5.

Within the main body 1 is contained a roll 11 of a thin sheet or film 10. The thin sheet or film 10 is pulled out of the roll 11 over the free end side of the fourth wall 4, passed through the gap between the first wall 2 and the covering piece 7, and drawn out of the main body 1. The drawn portion of the thin sheet or film 10 is pressed down against the corner 8 and then pulled downwardly slightly to the front side in the position shown in the diagram. Consequently, the thin sheet or film can easily be ripped in a substantially straight line along the corner 8. To be more specific, when the thin sheet or film 10 is pulled so as to be pressed down against the corner 8 as described above, the force thus exerted is concentrated along the edge of the coarse file-like face 9 bordering on the corner 8 and falling closer to the rear wall 5 of the main body 1. The very small, yet sharply pointed ridges of the coarse file-like face 9 impart numerous cuts in the portion of the thin sheet or film 10 along the corner 8. Because of the cuts thus formed, the thin sheet or film 10 can be easily ripped in a straight line.

Since the ridges of the coarse file-like face 9 have sharp corners but are very fine, the coarse file-like face 9 is totally different from all cutting blades of ordinary run. While the coarse file-like face 9 functions as a cutting edge as described above, it is quite safe because it will not hurt hands and fingers even when it is touched forcefully. This coarse file-like face 9 can be easily obtained as described more fully afterward. This fact contributes to improving the overall production efficiency of the dispenser as compared with the conventional dispensers. Further, since the coarse file-like face is an aggregate of very fine ridges, the amount of protrusion of the coarse file-like face 9 from the surface of the first wall 2 of the main body 1 can be reduced substantially to nothing. Thus, the otherwise inevitable inclination of the covering piece 7 placed on the coarse file-like face is eliminated, making it possible for a multiplicity of dispensers of this invention to be piled up stably in a large heap. When the coarse file-like face 9 is formed in a fairly fine line, the thin sheet or film 10 can be cut in a substantially straight line. Consequently, the possibility that the thin sheet or film 10 will be torn in the longitudinal direction from some of the V-shaped notches produced when the cut end forms a zigzag edge is completely precluded.

Examples of the thin sheet or film to which the present invention is directed include synthetic resin films generally called wrap films such as of polyvinylidene chloride, polyethylene, polyvinyl chloride, and polybutadiene, metallic foils such as aluminum foil, waxed paper, parchment paper, glassine, ordinary writing paper, recording papers for use in peripheral devices in the electronic computer system, relatively thin papers of short fibers, and laminates thereof.

The term "coarse file-like face" means a rugged surface formed of a material having greater rigidity than the thin sheet or film and containing microscopically sharp corners. The coarse file-like face fulfils its roll satisfactorily when it is rugged enough to impart fine cuts of varying shapes to the thin sheet or film. The work of applying the coarse file-like face as a cutting edge to a substrate and providing the resultant composite as a cutting device for the thin sheet or film dispenser can be carried out by any of the procedures indicated below. The coarse file-like face may be formed directly at the prescribed position on the dispenser case as the substrate, or it may be formed on a separate substrate with the resultant composite attached to the prescribed position of the dispenser.

Figure 2:
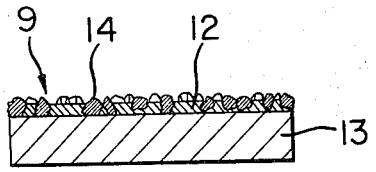
FIGS. 2–5 are enlarged sections illustrating substrates having coarse file-like faces formed thereon.

(1) Finely divided grindstone particles 14 are applied fast directly to the surface of a substrate 13 with the aid of an adhesive agent 12 as illustrated in FIG. 2, and the surface containing the applied grindstone particles is used as a coarse file-like face 9. In this case, the application of the grindstone particles 14 to the substrate may be accomplished by mixing the adhesive agent 12 with the grindstone particles 14 and spreading the mixture on the surface of the substrate or by mixing the grindstone particles 14 with an ink and transferring the mixture onto the surface of the substrate 13 at the same time that a print is applied to the substrate 13. When the application is effected by an electrodeposition technique or by spraying the grindstone particles 14 on the layer of the adhesive agent 12 formed in advance on the substrate, the microscopically sharp corners of the grindstone particles 14 are allowed to be surely exposed. Consequently, the coarse file-like face 9 to be produced possess a better cutting ability. When the application is effected by first mixing the grindstone particles 14 with the adhesive agent 12 and then spreading the mixture to the substrate, thorough exposure of the embedded grindstone particles 14 can be advantageously attained by lightly wiping or washing the applied layer of the mixture with a suitable solvent after the adhesive agent 12 has been hardened.

Figure 3:
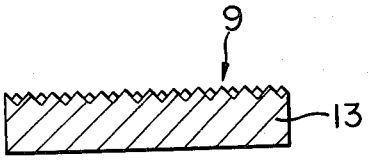

(2) The surface of a substrate 13 is fabricated so as to form fine cutting ridges as illustrated in FIG. 3, and the fabricated surface is used as a coarse file-like face 9. The formation of such fine cutting ridges on the surface of the substrate 13 can be accomplished by pressing, cutting, chiselling, drilling, or any other operation capable of coarsening the surface. In this case, the substrate 13 must be made of a substance having greater rigidity than the material of the thin sheet or film.

Figure 4:
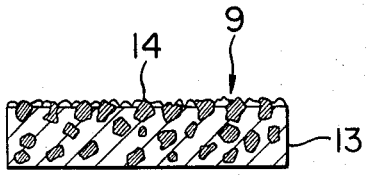

(3) The grindstone particles 14 are incorporated in advance in the material of the substrate 13 as illustrated in FIG. 4. The incorporation of grindstone particles 14 in the material of substrate can be effected in varying manners. When paper is adopted as the material for the substrate 13, for example, the incorporation may be obtained by causing the grindstone particles 14 to be mingled in conjunction with a filler into the pulp during the manufacture of paper. When a synthetic resin is adopted as the material for the substrate 13, it is accomplished by causing the grindstone particles 14 to be blended into the synthetic resin while the resin is in its molten state. In the case of using the synthetic resin as the substrate, the grindstone particles 14 embedded in the synthetic resin can be sufficiently exposed from the synthetic resin substrate by lightly wiping or washing the desired surface of the substrate 13 with a solvent after the synthetic resin has been thoroughly hardened. When the substrate 13 containing the coarse file-like face 9 is obtained by this particular method, the entire dispenser case may be readily formed by using only this substrate 13. The dispenser formed solely of the substrate 13, however, has a possibility of randomly flawing the thin sheet or film stored therein. To avoid the trouble, the substrate 13 containing the coarse file-like face 9 is desired to be used only in the prescribed position of the dispenser.

Figure 5:
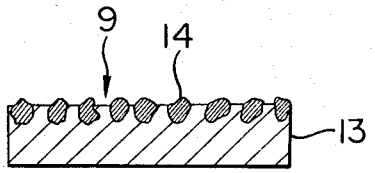

(4) The grindstone particles 14 are driven into a substrate 13 as illustrated in FIG. 5. When the substrate 13 has a relatively large thickness as shown in the diagram, the grindstone particles 14 may be sprayed on the surface of the substrate 13 and then pushed down into the substrate by means of a pressure until only their tops remain above the surface of the substrate 13. When the substrate 13 has a relatively small thickness as in paper, for example, the grindstone particles 14 may be sprayed on the rear surface of the substrate 13 and then pushed down into the substrate by means of a press until their tops emerge from the front surface of the substrate 13. In either of the cases described above, the ease of the work increases with the increasing size of the individual grindstone particles 14. Particularly when a layer of a hot-melt type adhesive agent is formed on the surface of the grindstone particles 14 and this layer is heated at the time the grindstone particles 14 are pressed into the substrate as described above, the grindstone particles are fastened with increased strength by the adhesive agent.

The substrate on which the coarse file-like face has been formed by any of the procedures of (1) through (4) may be the dispenser case itself as described above. When the substrate is made of a material separately of the dispenser case and the substrate having the coarse file-like face formed thereon is attached to the prescribed position on the dispenser case, there is derived the advantage that the material for the substrate can be freely selected from various materials including relatively soft materials such as synthetic resin sheet, paper, and cloth and rather rigid materials such as metallic, plastic, and ceramic plates. A desire to make an independent cutting device using the coarse file-like face as its cutting edge can be fulfilled by forming the substrate in a shape such that the substrate may concurrently serve as a holding member or by attaching to a separately prepared holding member the substrate formed of a separate material as described above. In the case of the substrate destined to be attached to the dispenser case, safe storage of the substrate can be accomplished by applying an adhesive agent to the rear surface of the substrate and then covering the applied adhesive agent layer with a release paper. The application of the substrate to the dispenser case can be made at any desired time by simply removing the release paper from the rear surface of the substrate. For this purpose, the labeling machine of popular use can be utilized. A proper mark printed in advance on the dispenser case to indicate the position at which the substrate is to be attached will prove convenient for accurate application of the substrate to the dispenser case.

For the production of the coarse file-like face by the procedures (1), (3), and (4) indicated above, any of the known grindstone particles such as of carborundum, alumina, and glass can be utilized. Generally, however, finely divided particles of virtually all rigid materials can be used so far as the particles have greater rigidity than the thin sheet or film to be cut. The grain size of the grindstone particles can be widely varied with the kind of the thin sheet or film to be cut. Generally, however, the grain size is desired to fall in the range of 20 to 150 mesh. The ruggedness of the cut end of the thin sheet or film is aggravated in proportion as the grain size of the grindstone particles increases. Inversely, the sharpness of the cutting edge decreases when the grain size of the grindstone particles is excessively small. Even in the procedure of (2) above in which the surface of the substrate itself is fabricated to form sharp cutting ridges thereon after the pattern of a film, the coarseness of the cutting ridges formed on the substrate is desired to equal to that of grindstone particles used in the other procedures. Specifically, the optimum grain size of the grindstone particles or cutting ridges is 80 to 120 mesh for polyvinylidene chloride film, 40 to 60 mesh for polyester and polybutadiene type films, and 20 to 30 mesh for commercially available aluminum foil.

The coarse file-like face to be formed on the thin sheet or film dispenser as described above is not always required to be in the shape of a plane. It may be in a linear shape. It may be even formed of one or a plurality of grindstone particles. For example, a multiplicity of grindstone particles may be arrayed in one straight row, only a few grindstone particles may be spaced in one row, or a grindstone particle of a relatively large size may be positioned immediately at the start of cutting. Macroscopically, the grindstone particles arranged as described above may appear as a simple line or a simple dot. Microscopically, however, they form a specific plane. Further, as will become apparent from the further disclosure of the invention made hereinafter, the desired cutting of the thin sheet or film is effected by the linear pressing of the sheet or film to the coarse file-like surface. So far as the coarse file-like face is formed at a proper position on the substrate, the cutting capacity thereof is not affected at all by the fact that the grindstone particles are macroscopically disposed as dots or lines. Further, the individual grindstone particles microscopically form distinct cutting ridges and grooves. A paint such as a fluorescent paint, a luminous paint, or a reflection paint prepared in a color sharply contrasted to the color of the dispenser case itself and applied to the coarse file-like face formed on the dispenser case proves very convenient for location of the coarse file-like face in a dark room.

The position of the dispenser case at which the coarse file-like face is to be formed is not specifically limited. It may be freely selected on the sole condition that the coarse file-like face provides easy cutting of the thin sheet or film in the direction of its width. Generally, the coarse file-like face is disposed in a direction perpendicular to the direction in which the thin sheet or film is drawn out of the roll. The coarse file-like face is not always required to be formed throughout the entire width of the thin sheet or film to be cut. Frequently it fulfils its purpose sufficiently when it is formed at least at the very position at which the cutting of the thin sheet or film is started. This is particularly true in the case of the thin sheet or film of polyvinylidene chloride which has a relatively low tear propagation strength. In this case, once a notch is inserted at one edge of the thin sheet or film, a light pull given by hand to the sheet or film in the direction of elongating the cut will suffice for causing the cut to advance. Thus, the sheet or film can be cut throughout the entire width thereof by merely guiding the advance of the cut in the desired direction, i.e. the direction of the width without having to rely on any cutting device. The cut can be formed readily in a straight line by guiding the advance of the cut along the corner of the dispenser case.

Now, the position and the condition of the coarse file-like face formed on the thin sheet or film dispenser case will be described with reference to the accompanying drawing.

Figure 6:
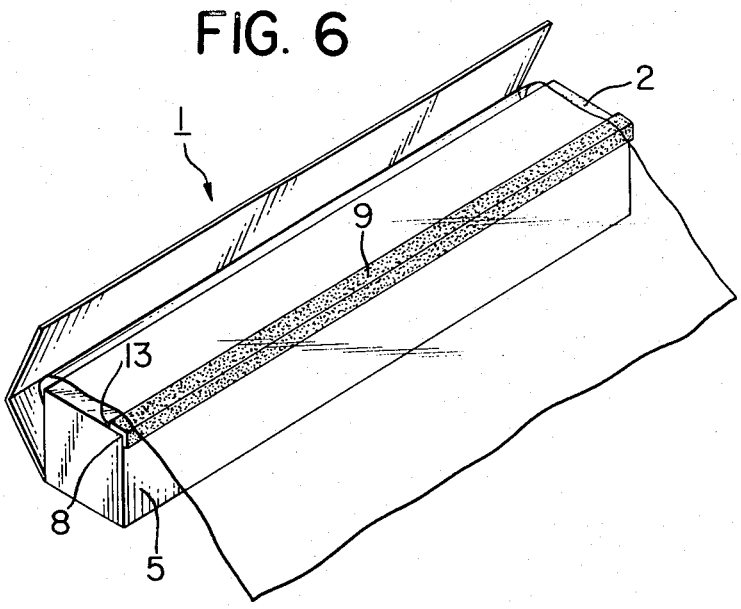
FIG. 6 is a perspective view illustrating another embodiment having a coarse file-like face provided for the dispenser of FIG. 1.
Figure 7:
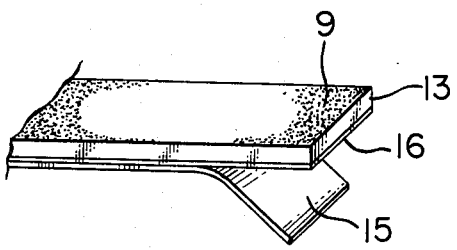
FIG. 7 is a perspective view of a part of the substrate containing a coarse file-like face and awaiting attachment to the dispenser of FIG. 6.

The main body 1 of the dispenser case illustrated in FIG. 6 is provided with a coarse file-like face 9 which is formed to cover the edges adjoining the corner 8 of the first wall 2 and the second wall 5 and stretching between the end of the first wall 2 on the second wall 5 side and the end of the second wall 5 on the first wall 2 side. In this case, the coarse file-like face 9 is formed on the substrate 13 separately from the main body 1 as illustrated in FIG. 7. Thus, the coarse file-like face 9 is formed by applying the substrate 13 as holding thereon the coarse file-like face 9 to the main body 1 as illustrated in FIG. 6. On the rear surface of the substrate 13 is applied a layer of adhesive agent 16 covered with a release paper 15. When this release paper 15 is peeled off the substrate 13, the substrate 13 is ready for application to the main body 1.

Figure 25:
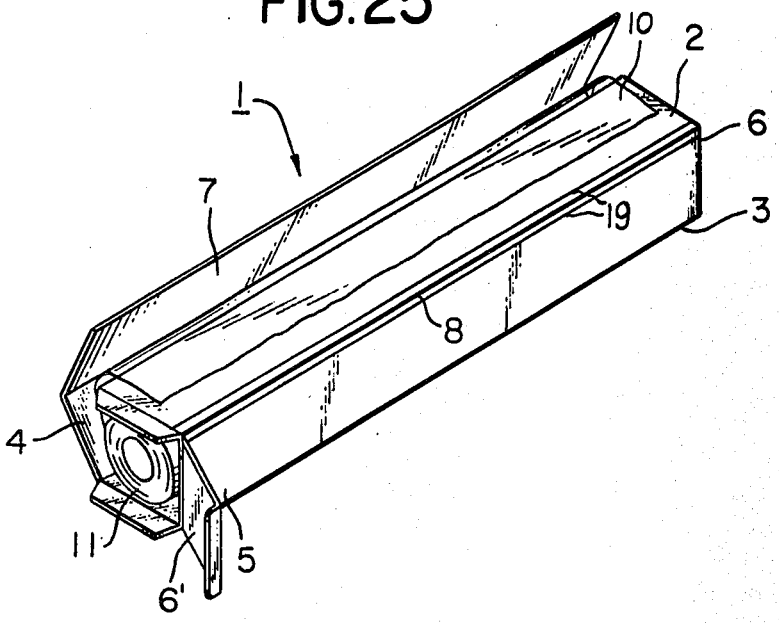
FIGS. 25–27 illustrate additional embodiments of the invention.

FIG. 25 illustrates the dispenser corresponding to that shown in FIG. 6 wherein the coarse file-like cutting face is not initially applied to the dispenser case but is loosely contained therein, and the marks 19 are provided on the dispenser case indicating the position for application of the adhesive-backed cutting face.

Figure 26:
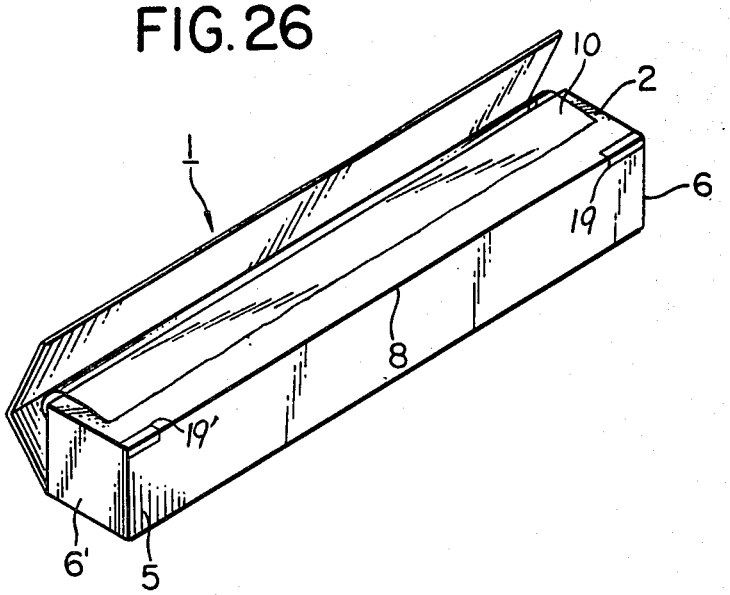
Figure 27:
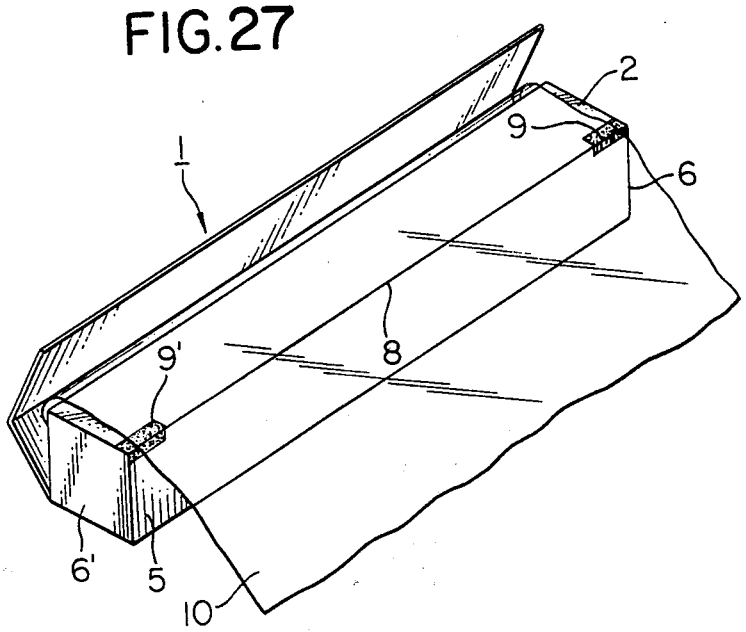

FIG. 26 illustrates the embodiment of the invention wherein the marks 19, 19' indicate the positions for applying the coarse file-like cutting face at opposite ends of the longitudinal corner of the dispenser, and FIG. 27 shows the dispenser after the face is so applied.

In this manner, accurate application of the coarse file-like face 9 to the corner 8, the very position that permits the easiest cutting of the thin sheet or film, can be accomplished without fail. Particularly in the case of the substrate 13 which is made of a material independently of the main body 1 and which has the coarse file-like face 9 formed thereon, this substrate 13 may be loosely contained within the main body 1 for the purpose of distribution. The end user, when opening the dispenser case to start its use, has only to pick out the substrate 13 and apply it to the prescribed position on the main body 1. In this manner, the time and labor to be spent at the factory in applying the substrate 13 containing the coarse file-like face 9 as a cutting edge to the main body 1 can be saved. When the cutting capacity of the cutting edge is degraded, the substrate 13 containing the worn file-like face can be readily replaced with a new supply. In this case, the dispenser case is desired to indicate thereon the position at which the substrate 13 is to be fastened.

Figure 8:
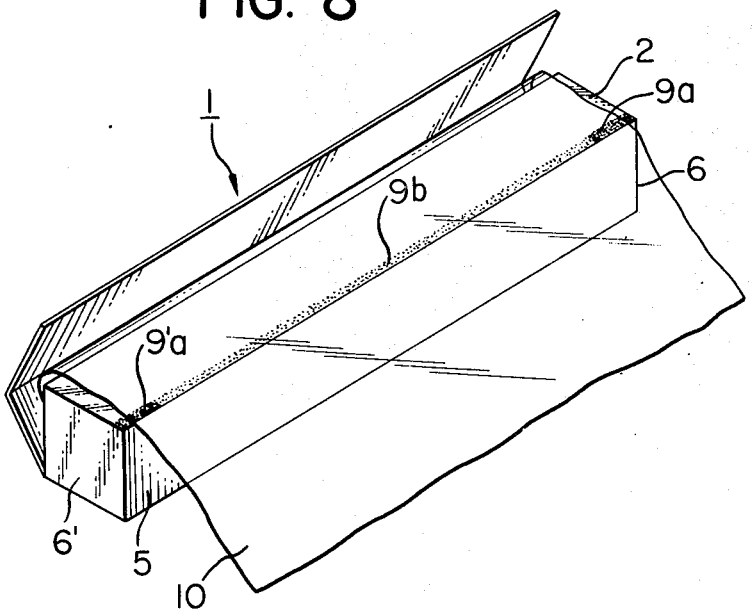
FIGS. 8–16 are perspective views illustrating other embodiments of the attachment of varying coarse file-like faces to the dispenser of FIG. 1.

The main body 1 of the dispenser case illustrated in FIG. 8 is provided with relatively coarse file-like faces 9*a*, 9'*a* directly along the corner 8 of the first wall 2 and the second wall 5 adjacently to the opposite ends of the first wall 2 on the second wall 5 side close to the two lateral walls 6, 6'. In the interval between the relatively coarse file-like faces 9*a*, 9'*a*, there is disposed a relatively fine file-like face 9*b* directly along the corner 8.

In this special arrangement, the initial cutting of the thin sheet or film 10 which requires a relatively large force is effected by causing the relatively coarse file-like face 9*a* or 9'*a* having a higher cutting capacity to insert a notch to the thin sheet or film 10. Because of the notch thus formed, the cut of the thin sheet or film 10 can be elongated in the direction of the width with a relatively small force. Then, the elongation of the cut can be effected by pulling the thin sheet or film 10 against the relatively fine file-like face 9*b* which has a rather poor cutting capacity but permits neat cutting. Even when the thin sheet or film 10 is such that it cannot be smoothly cut by the relatively fine file-like face 9*b* alone, it can be cut neatly by the combined work of the relatively coarse file-like faces 9*a*, 9'*a* and the relatively fine file-like face 9*b*. In this case, the coarse file-like faces 9*a*, 9'*a* are formed closely to the two lateral walls 6, 6' so that the initial cutting may be started on the left-hand edge or the righthand edge of the thin sheet or film 10. Thus, the dispenser case of this construction can be conveniently handled equally by left-handed and right-handed persons. Optionally, either of the two coarse file-like faces 9*a*, 9'*a* may be omitted depending on the left-handedness or right-handedness of the user.

Figure 9:
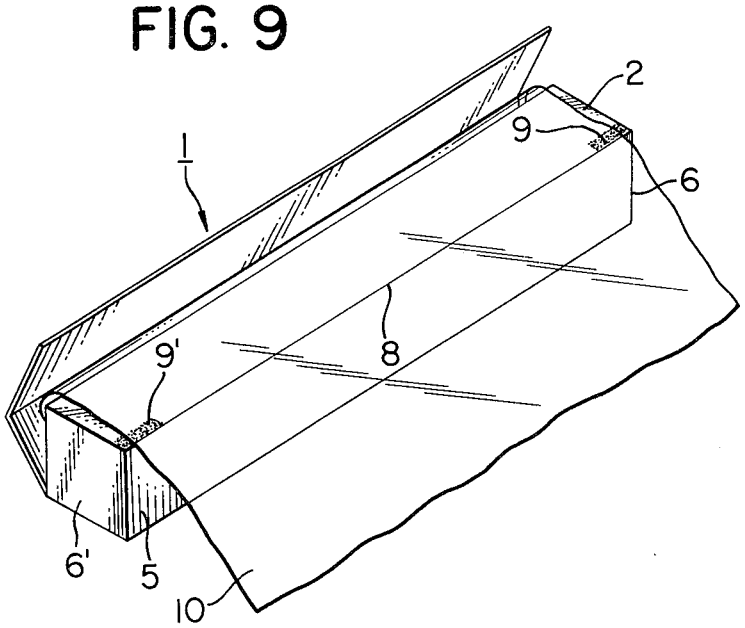

The main body 1 of the dispenser case illustrated in FIG. 9 is provided with coarse file-like faces 9, 9' directly along the corner of the first wall 2 and the second wall 5 adjacently to the opposite ends of the first wall 2 on the second wall 5 side close to the two lateral walls 6, 6'.

The disposition of the coarse file-like faces 9, 9' described above proves particularly advantageous when the thin sheet or film 10 to be cut has relatively small tear propagation strength as in the film of polyvinylidene chloride, for example. Once the coarse file-like face 9 or 9' inserts a notch in the thin sheet or film 10 as the starting point of a cut, the cut can be elongated with a relatively small force. Then, the desired elongation of the cut from this notch can be effected by guiding the front of the cut along the corner 8. Consequently, the thin sheet or film 10 can be cut with a neat edge as though formed by a sharp knife. In this case, therefore, there is virtually no possibility of the thin sheet or film 10 being torn with a zigzagging edge. In this case, the coarse file-like faces 9, 9' are formed closely to the two lateral walls 6, 6' so that the initial cutting may be started on the lefthand edge or the righthand edge of the thin sheet or film 10 similarly to the file-like faces shown in FIG. 8. Optionally, either of the two coarse file-like faces may be omitted by the same reason as given above.

Figure 10:
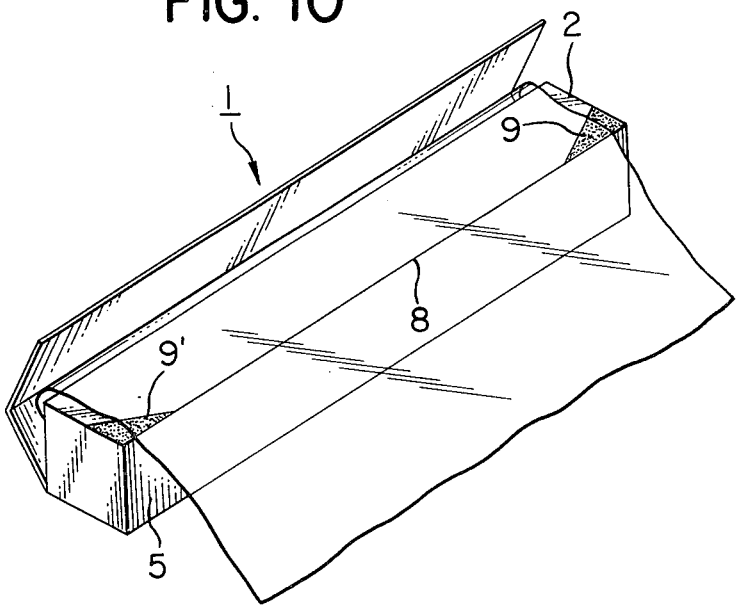

The dispenser case illustrated in FIG. 10, similarly to that of FIG. 9, is provided with coarse file-like faces 9, 9' directly adjacently to the corner 8 of the first wall 2 and the second wall 5. In this case, the coarse file-like faces 9, 9' are formed at the corners of the first wall 2 each in the shape of a triangle.

When the coarse file-like faces 9, 9' of the shape mentioned above are disposed at the corners of the first wall 2, there is derived the advantage that they can be positioned rather easily. Further when these coarse file-like faces 9, 9' are formed on the substrate 13 made of the separate material as illustrated in FIG. 7 and the substrate 13 is then fastened to the main body 1 of the dispenser case, there is derived the advantage that the triangular coarse file-like faces are less easily separated from the dispenser case during the use than the relatively slender coarse file-like faces illustrated in FIG. 9.

Figure 11:
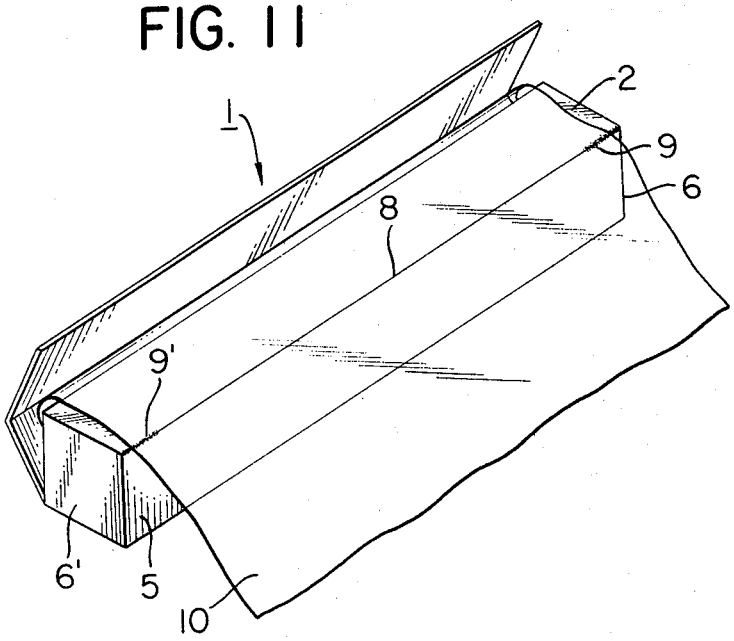

The main body 1 of the dispenser case illustrated in FIG. 11 is provided with coarse file-like faces 9, 9' formed substantially in the shape of lines on the corner 8 of the first wall 2 and the second wall 5 closely to the two lateral walls 6, 6'.

In this arrangement, since the desired cutting of the thin sheet or film 10 can be effected without fail by simply having the coarse file-like faces 9, 9' in highly limited portions, the dispenser case can retain its good appearance.

Figure 12:
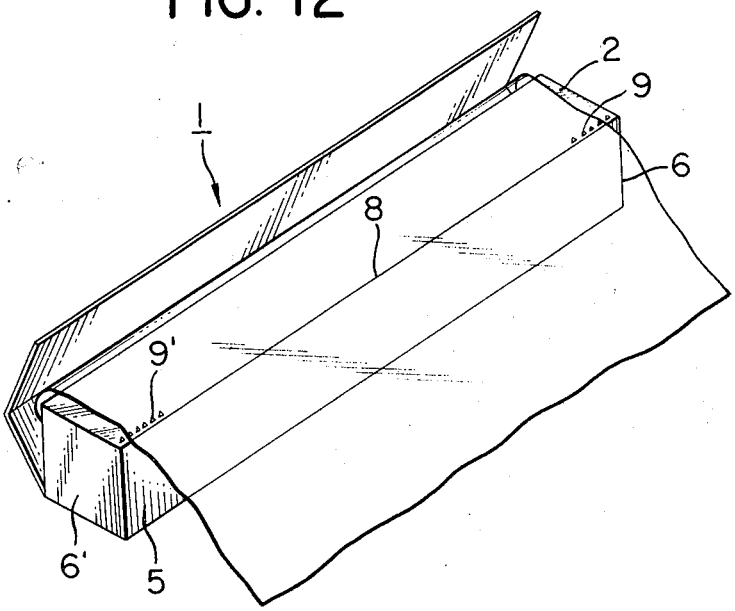

The main body 1 of the dispenser case illustrated in FIG. 12 is provided with coarse file-like faces 9, 9' formed substantially in the shape of dotted lines along the corner 8 of the first wall 2 and the second wall 5 on the first wall 2 closely to the two lateral walls 6, 6'. The coarse file-like faces 9, 9' are formed by having coarse grindstone particles driven into the substrate in a straight row.

In this construction, although the individual grindstone particles thus embedded in the substrate are fairly large, the amount of their protrusion from the surface of the substrate is very small. Further, the space separating the protruding heads of these individual grindstone particles can be freely regulated. When the coarse file-like faces 9, 9' are formed so that the protruding heads of the grindstone particles may be sparsely spaced, they become so inconspicuous as to have substantially no adverse effect upon the appearance of the dispenser case.

Figure 13:
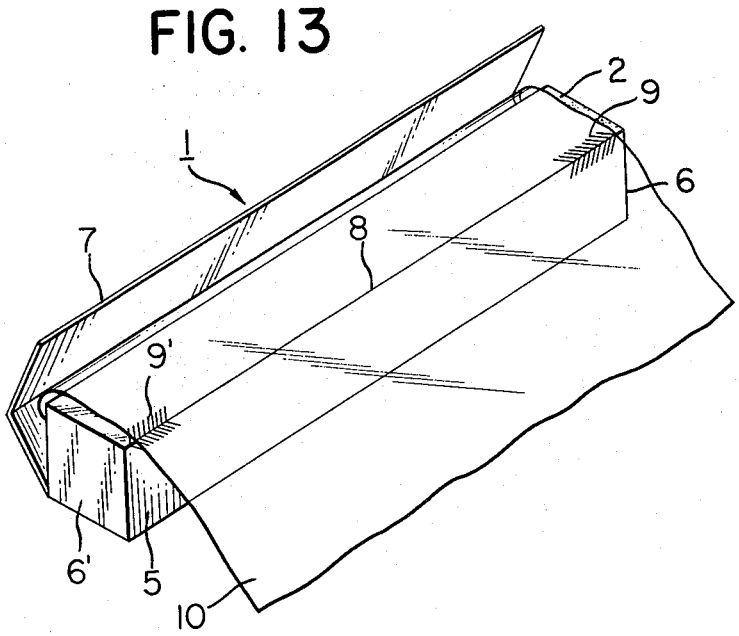

The main body 1 of the dispenser case illustrated in FIG. 13 is provided with coarse file-like faces 9, 9' which are formed by cutting fine grooves in the corner 8 portion of the main body 1 along the portions of the corner 8 of the first wall 2 and the second wall 5 adjacently to the two lateral walls 6, 6'. The individual grooves are inclined from the two lateral walls 6, 6' to the center of the main body. Consequently, in the areas of the coarse file-like faces 9, 9', the corner 8 possesses sharply pointed edges directed toward the two lateral walls 6, 6'.

Figure 14:
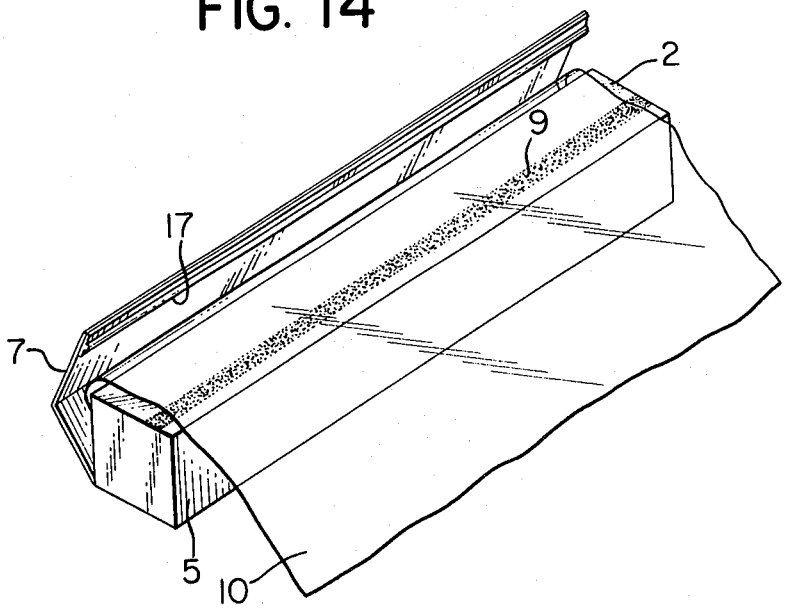

In this arrangement, the coarse file-like faces 9, 9' do not protrude at all from the first wall 2 or any other wall. When the covering piece 7 is laid on the coarse file-like faces 9, 9', it is not inclined by reason of the presence of such coarse file-like faces. When a multiplicity of main bodies 1 of the construction illustrated here which are elongated rectangular parallelepipeds are piled up in high heaps, they remain stably. The cutting of the thin sheet or film 10 is effected advantageously by the pointed edges of the corner 8 described above. Particularly in this case, the main body 1 is desired to be made of a relatively rigid material such as a hard synthetic resin, for example. The main body 1 of the dispenser case illustrated in FIG. 14 is provided with a coarse file-like face 9 which is formed in the shape of a strip across the entire length of the main body 1 in the portion of the first wall 2 closer toward the second wall 5. At the same time, the covering piece 7 intended for covering the first wall 2 is provided at the portion corresponding to the portion of the coarse file-like face 9 with a continuous ridge 17 which serves to press the thin sheet or film against the coarse file-like face.

In this construction, the thin sheet or film 10 drawn out of the main body 1 to a desired length can be easily cut by placing the covering piece 7 on the first wall 2 thereby nipping the thin sheet or film 10 between the coarse file-like face 9 and the continuous ridge 17, and pulling the drawn thin sheet or film 10 nearly horizontally in the direction departing from the main body. Since the thin sheet or film 10 is accurately ripped along the continuous ridge 17 so long as the continuous ridge 17 is kept tightly pressed down, the possibility of unsuccessful cutting is remote particularly when the thin sheet or film has a small width.

Figure 15:
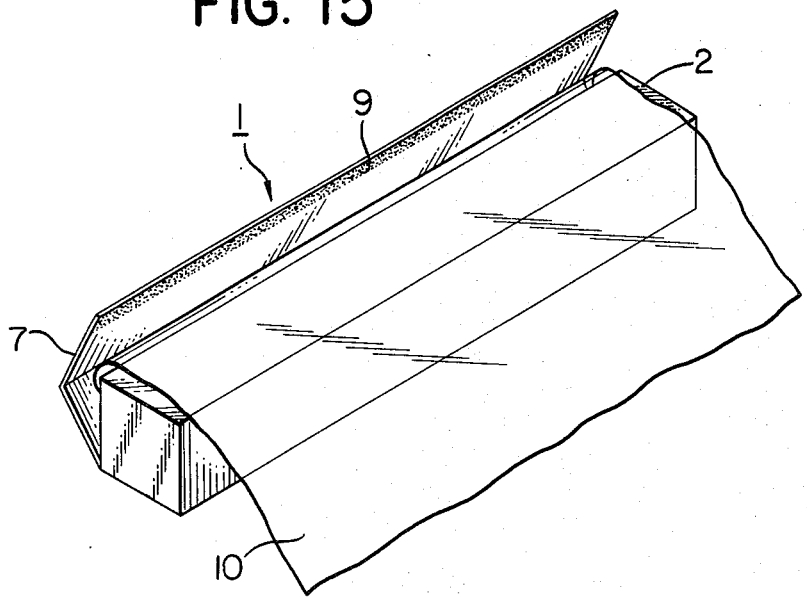

The main body 1 of the dispenser case illustrated in FIG. 15 is provided along the leading end of the inner surface of the covering piece 7 with a coarse file-like face 9.

In this construction, the thin sheet or film 10 drawn out of the main body 1 to a desired length can be easily cut off by placing the covering piece 7 on the first wall 2 thereby nipping the drawn thin sheet or film 10 between the covering piece 7 and the first wall 2 and then pulling the thin sheet or film slightly upwardly against the pressure of the coarse file-like face 9. In this construction, a member resembling the continuous ridge 17 found in the construction of FIG. 14 may be provided at the portion of the first wall 2 corresponding to the coarse file-like face 9.

Figure 16:
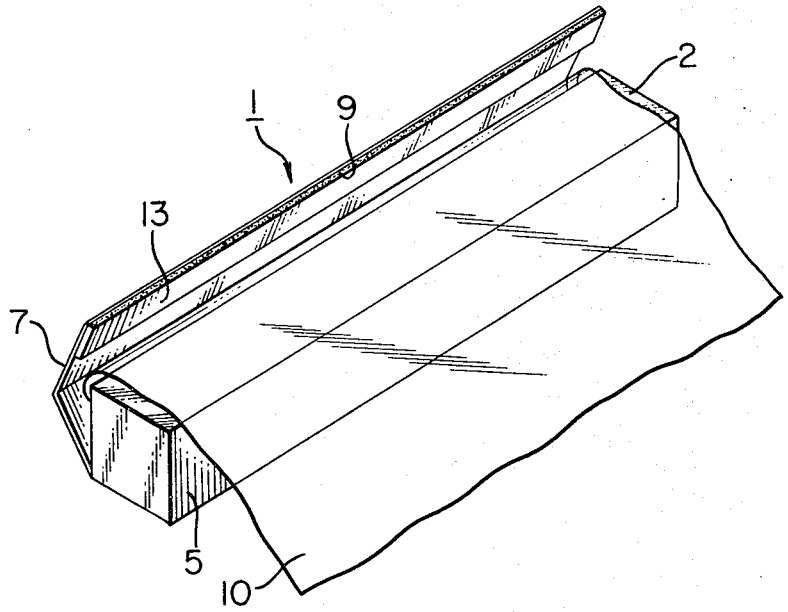

The main body 1 of the dispenser case illustrated in FIG. 16 is provided at the leading end of the inner surface of the covering piece 7 with a substrate 13 which is formed of a material separately of the main body 1 and which is provided on the edge face thereof on the second wall 5 side with a coarse file-like face 9.

In this construction, the thin sheet or film 10 drawn out of the main body to a desired length can be cut in much the same way as in the construction of FIG. 15. In this case, when the substrate 13 is formed of a metal plate, for example, there is derived the advantage that the substrate 13 prevents the covering piece 7 from otherwise possible deformation and, therefore, enables the drawn thin sheet or film 10 to be easily nipped between the covering piece 7 and the first wall 2. There is also derived the advantage that the thin sheet or film 10 suffers a less possibility of damage due to being scraped against the coarse file-like face 9 while it is being drawn out of the main body 1.

As is clear from the various embodiments described so far, the position at which the coarse file-like face is to be disposed is not specifically limited so far as the coarse file-like face is formed in a manner such that at least the edge of the thin sheet or film at which the cutting is to be started will be pressed down linearly against the coarse file-like face.

Figure 17:
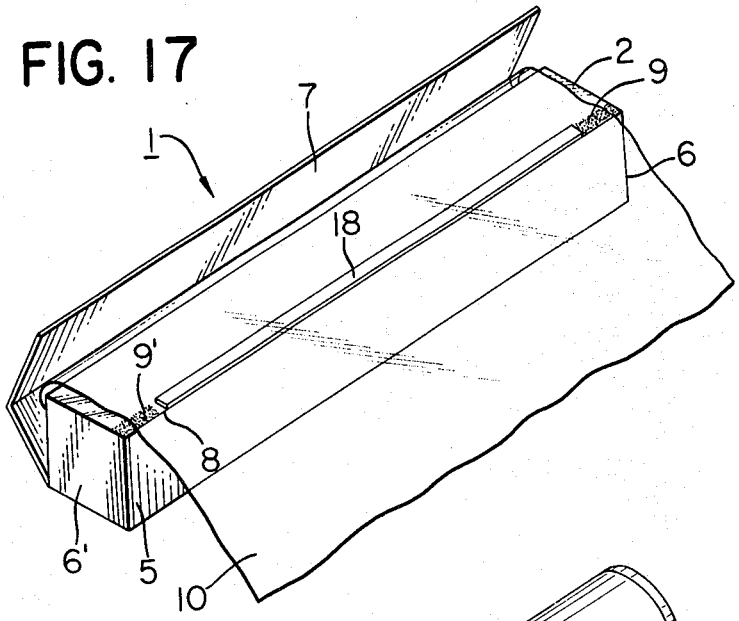
FIG. 17 is a perspective view of the same dispenser as shown in FIG. 1, with an auxiliary member incorporated therein for the purpose of faciliting the cutting work involved.

FIG. 17 illustrates a dispenser case which is provided with an auxiliary member designed to facilitate the cutting work. To be more specific, the main body 1 of the dispenser case illustrated in FIG. 17 is provided with coarse file-like faces 9, 9' directly along the corner 8 of the first wall 2 and the second wall 5 on the second wall 5 side end of the first wall 2 adjacently to the two lateral walls 6, 6'. In the interval between the two coarse file-like faces 9, 9', a slippery tape 18 is fastened to the main body 1. This slippery tape 18 is made of a material such as a silicon-coated paper tape or a satin aluminum tape which has a smaller frictional resistance to the thin sheet or film 10 than the main body 1 at least. In this construction, when the notch formed by the coarse file-like face 9 or 9' in the thin sheet or film 10 as the starting portion of the cut is elongated along the corner 8, the slippage provided by the slippery tape 18 serves to prevent the thin sheet or film 10 from being readily wrinkled along the corner 8. Further, the slippery tape 18 facilitates the elongation of the cut along the corner 8. Consequently, the possibility that the thin sheet or film 10 will be heavily furrowed or caught on the corner 8 and the cut line will consequently deviate from the corner 8 is substantially eliminated. The slippery tape 18 may be applied so as to cover the mutually adjoining edge portions of the first wall 2 and the second wall 5 astride the corner 8. Otherwise, the main body 1 itself may be processed so as to form a slippery face at the portion under discussion. Not merely the corner 8 portion in the construction illustrated here but any of the cut-guiding portions in the other embodiments is enabled to provide accurate guidance of the cut line when improved slippage is imparted thereto. The slippery tape 18 may be advantageously disposed on the inner surface of the covering piece 7.

Now, the dispenser case on which the coarse file-like face is provided will be described. Generally, the dispenser case is a box made of paper in the shape of an elongated rectangular parallelepiped. For the purpose of the present invention, it is not limited to this shape. The dispensers of various shapes, constructions, and materials can be used.

Figure 18:
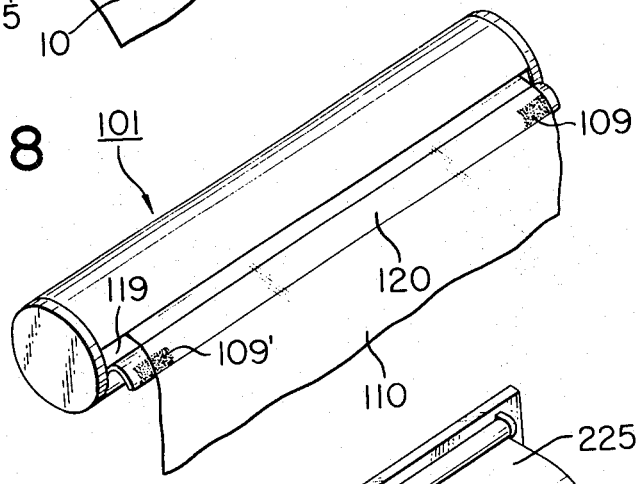
FIG. 18 is a perspective view illustrating a cylindrical dispenser.

FIG. 18 is a perspective view of a typical dispenser case in a cylindrical shape. In the peripheral wall of the main body 101 of this cylindrical dispenser, a slender outlet opening 119 for drawing out the thin sheet or film 110 is formed in the axial direction. The lower edge of this outlet opening 119 is projected outwardly from the main body 101 to form a guide piece 120. At the opposite ends of the guide piece 120, there are provided coarse file-like faces 109, 109'.

This dispenser is used much the same way as any of the dispenser cases described above. The thin sheet or film 110 drawn out of the roll contained inside the main body 101 through the outlet opening 119 is cut by pressing the drawn thin sheet or film 110 against the coarse file-like face 109 or 109' to insert a notch in the sheet or film 110 as the starting portion for the cut and subsequently guiding the elongation of this cut along the leading end of the guide piece 120. Instead of the two coarse file-like faces 109, 109', there may be provided one continuous coarse file-like face throughout the entire length of the guide piece 120. Optionally, the coarse file-like face may be formed on the edge surface at the leading end of the guide piece 120.

Figure 19:
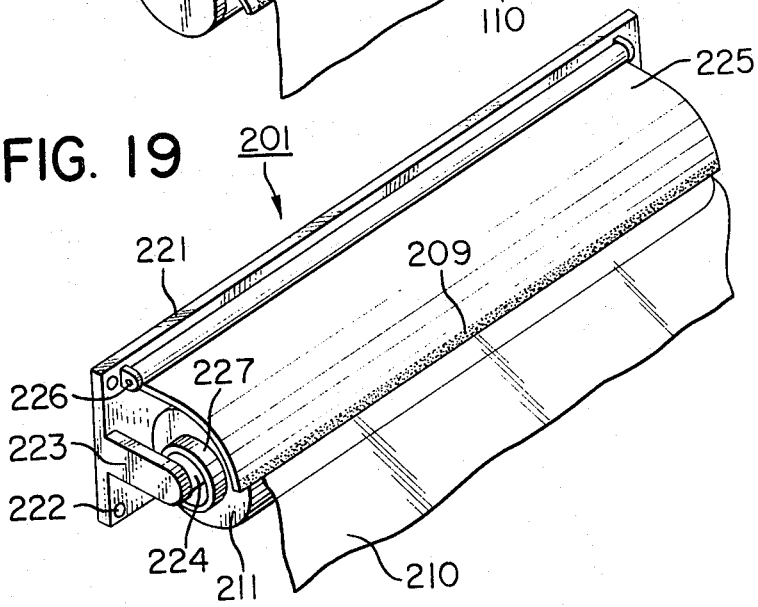
FIG. 19 is a perspective view illustrating a wall dispenser.

FIG. 19 is a perspective view illustrating a typical wall dispenser. A fitting plate 221 forming the rear wall of the main body 201 is provided at the four corners thereof with fitting holes 222, so that the dispenser may be fastened to a given wall with nails or screws driven through the fitting holes 222 into the wall. Optionally, the dispenser may be attached to the wall through the medium of a double-faced adhesive tape or suction discs instead of the fitting holes 222. From the opposite ends of the fitting plate 221, support members 223 are thrust out forwardly. The two support members 223 are adapted to support a central shaft 224 freely detachably. By 225 is denoted a covering piece which is adapted to rotate about a rotary shaft 226. This covering piece 225 is provided along the edge at the leading end thereof with a coarse file-like face 209. Denoted by 227 is a paper tube serving as the core of the roll 211 of the thin sheet or film 210.

This dispenser is prepared for use by inserting the central shaft 224 in the cavity of the paper tube 227 and setting it in position on the support members 223. The thin sheet or film 210 can be drawn out of the roll 211 to a desired length by pulling the free end of the thin sheet or film 210 and causing the roll to rotate on the central shaft. The drawn thin sheet or film 210 can be easily cut by allowing the leading end of the covering piece 225 to fall on the thin sheet or film 210 and then pulling the sheet or film upwardly against the pressure exerted by the leading end of the covering piece 225. Since the covering piece 225 is freely rotatable as described above, the leading end thereof falls naturally on the drawn thin sheet or film 210 owing up the own weight of the covering piece and keeps the roll 211 covered lightly enough not to interfere with the extraction of the thin sheet or film 20 from the roll 211. Thus, the roll 211 can be prevented from gathering dirt.

Figure 20:
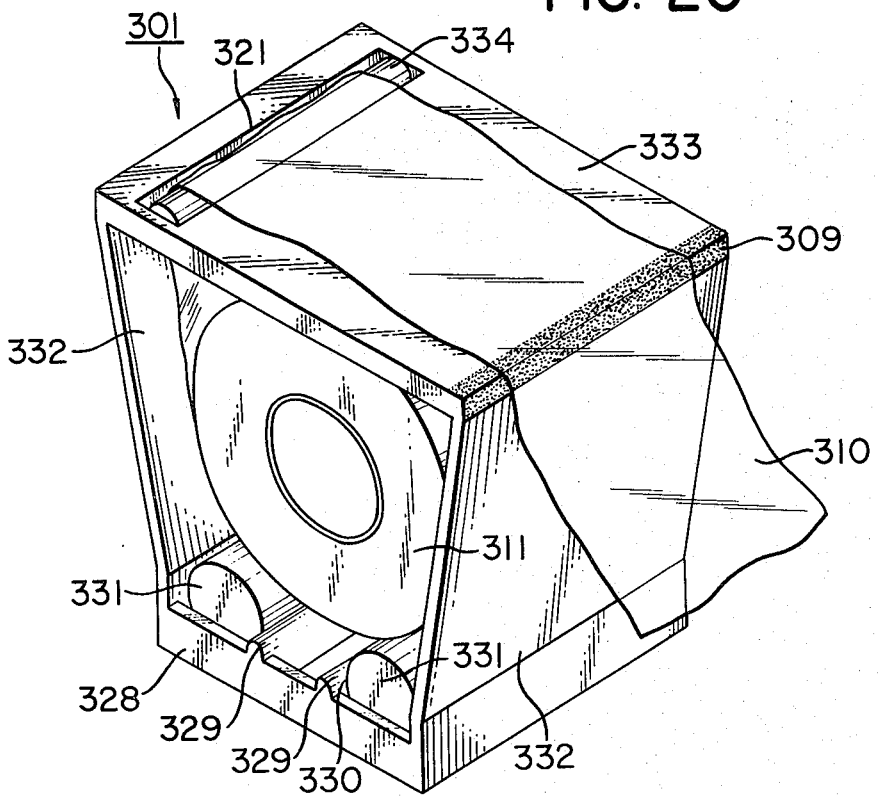
FIG. 20 is a perspective view illustrating a table dispenser.

FIG. 20 is a perspective view illustrating a typical table dispenser. The main body 301 of this dispenser contains therein a roll 311 of a thin sheet or film 310. On the bottom face 328 of the main body 301, two partition plates 329 are raised to form grooves 330. Within the grooves 330, two rolls 331 are detachably rotatably inserted. When the roll 311 of the thin sheet or film 310 is mounted on the two rolls 311, the roll 311 is smoothly rotated about its axis with the periphery thereof kept in contact with the two rolls 311. By 332 is denoted side plates rising upwardly from the bottom face 328. These side plates support at its upper end a flat upper plate 333. Denoted by 334 is a guide roll which is rotatably set in position within an outlet opening 319 formed along one end of the upper plate 333. A coarse file-like face 309 is formed across the corner of the end of the upper plate 333 opposite the side containing the outlet opening 319 and the upper end of the side plate 332.

This dispenser is prepared for use by first inserting the rolls 331 in the two grooves 330. Since the interiors of these grooves 330 are smoothly finished, the rolls 331 are allowed to rotate within the grooves 330 without encountering any resistance. A wall of a small height or a freely openable door may be provided between the two side plates 332 for the purpose of preventing the rolls 331 and the roll 311 of the thin sheet or film 310 from falling off the main body 301. Then, the roll 311 of the thin sheet or film 310 is placed on the two rolls 331, and the free end of the thin sheet or film 310 is pulled out, passed over the guide roll 334, sent through the outlet opening 319, and drawn out over the upper plate 333. When the thin sheet or film 310 is paper, then the drawn portion of the paper now placed on the upper plate 333 can be used as a writing slip. The thin sheet or film 310 can be easily cut by drawing the leading end to a desired length past the coarse file-like face 309 and pulling it downwardly against the coarse file-like face 309.

Figure 21:
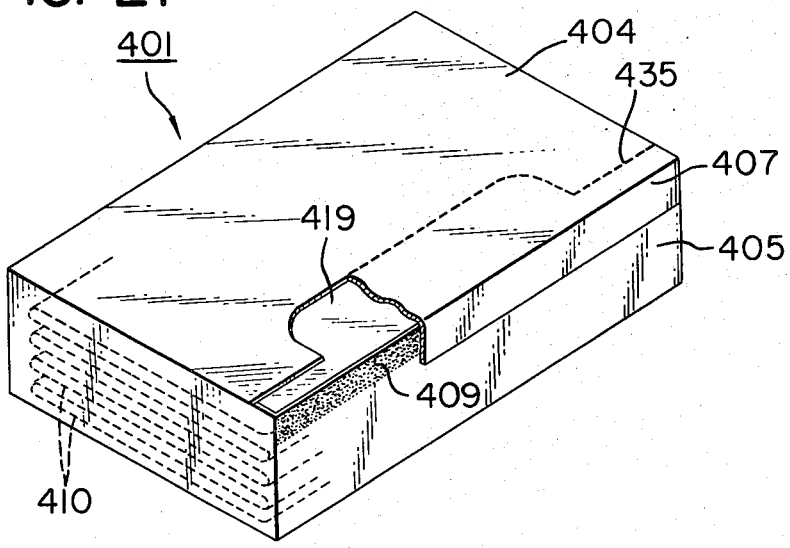
FIG. 21 is a perspective view illustrating a dispenser containing a folded strip of thin sheet or film.
Figure 22:
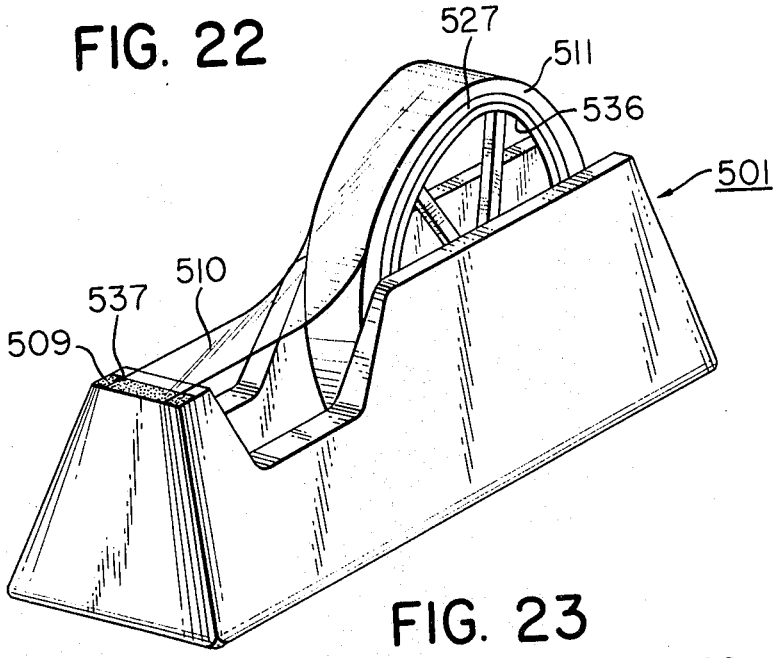
FIG. 22 is a perspective view illustrating a dispenser for a pressure sensitive adhesive tape.
Figure 23:
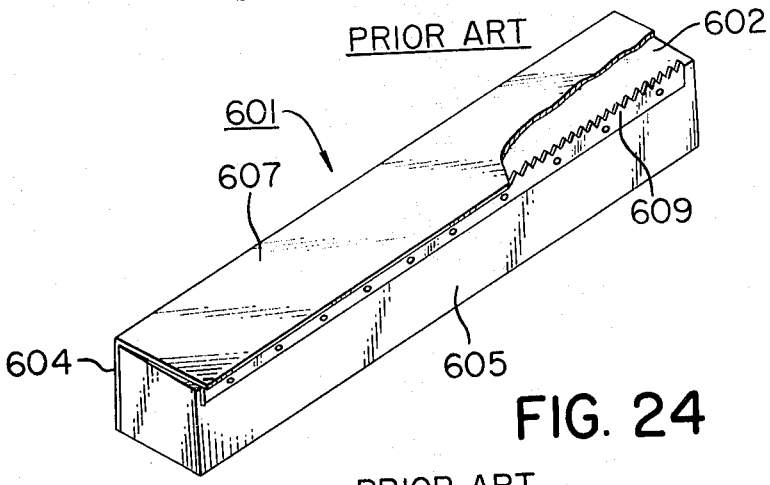
FIG. 23 PRIOR ART
FIGS. 23–24 are explanatory diagrams of the prior art.
Figure 24:
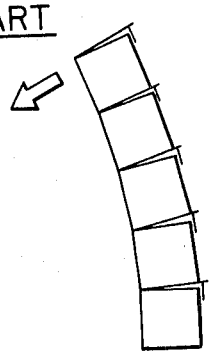
FIG. 24 PRIOR ART

FIG. 21 is a perspective view illustrating a typical dispenser containing the thin sheet or film in a folded form. Within the main body 401 of this dispenser, the thin sheet or film 410 folded in a zigzag form is con-